US010427924B2

(12) United States Patent
Schöttke et al.

(10) Patent No.: US 10,427,924 B2
(45) Date of Patent: Oct. 1, 2019

(54) INDUSTRIAL TRUCK COMPRISING A DEVICE FOR REDUCING VIBRATIONS

(71) Applicant: Jungheinrich Aktiengesellschaft, Hamburg (DE)

(72) Inventors: Carsten Schöttke, Moosburg (DE); Ernst-Peter Magens, Ammersbek (DE); Jürgen Schmalzl, Haimhausen (DE); Hubert Bibernell, Landshut (DE)

( * ) Notice: Subject to any disclaimer, the term of this patent is extended or adjusted under 35 U.S.C. 154(b) by 0 days.

(21) Appl. No.: 15/498,514

(22) Filed: Apr. 27, 2017

(65) Prior Publication Data

US 2017/0313563 A1 Nov. 2, 2017

(30) Foreign Application Priority Data

May 2, 2016 (DE) ..... 10 2016 207 526

(51) Int. Cl.
*B66F 9/075* (2006.01)
*B66F 9/12* (2006.01)
(Continued)

(52) U.S. Cl.
CPC ..... *B66F 9/07* (2013.01); *B66F 9/07559* (2013.01); *B66F 9/122* (2013.01); *B66F 9/148* (2013.01)

(58) Field of Classification Search
CPC ..... B66F 9/07559; B66F 9/122; B66F 9/148
(Continued)

(56) References Cited

U.S. PATENT DOCUMENTS 3,561,628 A * 2/1971 Melin ..... B66F 9/122 414/607
3,937,346 A 2/1976 van der Laan
(Continued)

FOREIGN PATENT DOCUMENTS

CN 105668462 6/2016
DE 2512521 9/1976
(Continued)

OTHER PUBLICATIONS

U.S. Appl. No. 15/631,096 , "Non-Final Office Action", dated Nov. 16, 2018, 11 pages.
(Continued)

*Primary Examiner* — James Keenan
(74) *Attorney, Agent, or Firm* — Kilpatrick Townsend & Stockton LLP

(57) ABSTRACT

The invention relates to an industrial truck comprising a mast, a load-carrying apparatus, which can be moved upwards and downwards thereon and which has at least one load-receiving assembly for receiving a load that is to be transported, and a support structure connecting the load-receiving assembly to the mast, the load-receiving assembly having a load-carrying arrangement connected to the support structure, and a device for reducing vibrations, characterized in that the device for reducing vibrations has at least one load support, which covers the load-carrying arrangement at the top at least in regions, on which support a load received by the load-carrying apparatus can be supported and which support is provided so as to be movable to a limited extent on the load-carrying arrangement such that it can perform vibration-reducing movements relative to the load-carrying arrangement.

13 Claims, 3 Drawing Sheets

Figure 1:
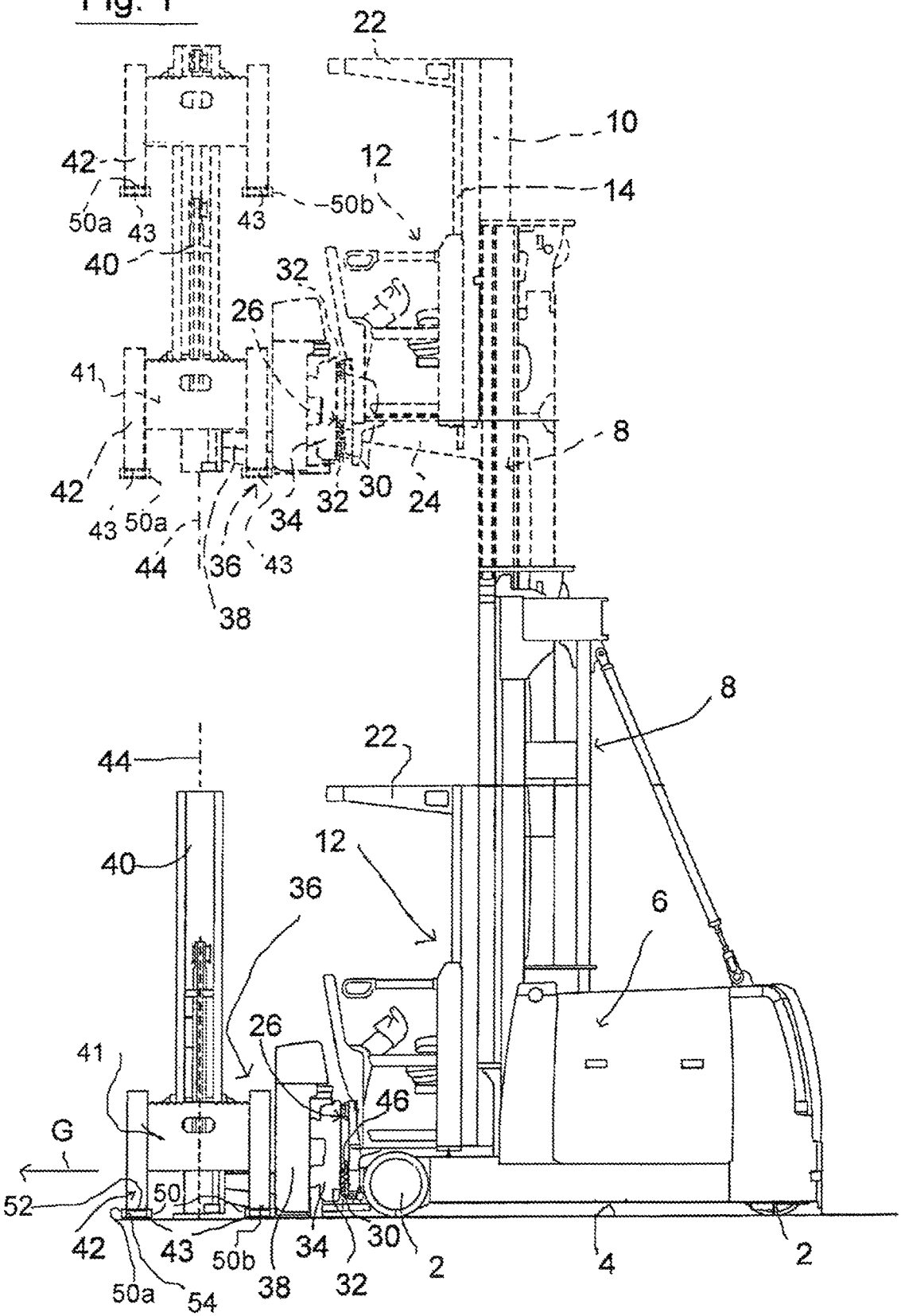

(51) Int. Cl.
*B66F 9/07* (2006.01)
*B66F 9/14* (2006.01)

(58) Field of Classification Search
USPC ..... 187/237; 414/662–672, 785
See application file for complete search history.

(56) References Cited

U.S. PATENT DOCUMENTS

| | | | | |
|---|---|---|---|---|
| 4,218,170 | A | 8/1980 | Goodacre | |
| 4,439,102 | A | 3/1984 | Allen | |
| 5,657,834 | A | 8/1997 | Plaugher et al. | |
| 7,736,115 | B2 * | 6/2010 | Lambert | B60P 1/027 414/474 |
| 7,980,807 | B2 * | 7/2011 | Schoenauer | B66F 9/148 414/671 |
| 8,078,368 | B2 | 12/2011 | Hall | |
| 8,944,744 | B2 * | 2/2015 | Kleeberger | B66F 9/07545 414/664 |
| 9,403,667 | B2 * | 8/2016 | McCabe | B66F 9/07559 |
| 9,890,025 | B2 * | 2/2018 | Colantonio | B66F 9/063 |
| 10,046,812 | B2 * | 8/2018 | Schmalzl | B66F 9/07559 |
| 10,266,379 | B2 | 4/2019 | Schöttke et al. | |
| 10,308,489 | B2 | 6/2019 | Magens et al. | |
| 2005/0156391 | A1 | 7/2005 | Krenzin et al. | |
| 2006/0182588 | A1 | 8/2006 | Beckett et al. | |
| 2007/0116548 | A1 * | 5/2007 | Cooper | B66F 9/122 414/619 |
| 2009/0312875 | A1 * | 12/2009 | Lehtonen | B66F 9/07559 700/280 |
| 2009/0314582 | A1 * | 12/2009 | Meijer | B66F 9/122 187/237 |
| 2015/0040481 | A1 | 2/2015 | Stover et al. | |
| 2016/0214659 | A1 | 7/2016 | Schmalzl et al. | |
| 2017/0313565 | A1 | 11/2017 | Magens et al. | |
| 2017/0327362 | A1 | 11/2017 | Schmalzl et al. | |
| 2017/0349418 | A1 | 12/2017 | Schmalzl et al. | |
| 2017/0369293 | A1 | 12/2017 | Schmalzl et al. | |
| 2017/0369294 | A1 | 12/2017 | Magens et al. | |

FOREIGN PATENT DOCUMENTS

| | | |
|---|---|---|
| DE | 8806324 | 8/1988 |
| DE | 3925668 | 2/1991 |
| DE | 4016497 | 11/1991 |
| DE | 4019075 | 12/1991 |
| DE | 10054789 | 5/2002 |
| DE | 10055751 | 5/2002 |
| DE | 10240851 | 5/2003 |
| DE | 102004002188 | 8/2005 |
| DE | 102004045698 | 3/2006 |
| DE | 602004001979 | 3/2007 |
| DE | 102008020592 | 10/2009 |
| DE | 102008020595 | 10/2009 |
| DE | 102013014094 | 3/2015 |
| DE | 102013113428 | 6/2015 |
| DE | 202015004375 | 4/2016 |
| DE | 102015201098 | 7/2016 |
| EP | 2368832 | 6/2013 |
| EP | 2881358 | 6/2015 |
| FR | 2243144 | 4/1975 |
| GB | 2379434 | 9/2004 |
| JP | H04130294 | 11/1992 |
| JP | 2004277068 | 10/2004 |
| JP | 2006160406 | 6/2006 |

OTHER PUBLICATIONS

U.S. Appl. No. 15/498,515 , "Non-Final Office Action", dated Aug. 31, 2018, 12 pages.
U.S. Appl. No. 15/592,236 , "Non-Final Office Action", dated Aug. 10, 2018, 11 pages.
U.S. Appl. No. 15/610,753 , "Non Final Office Action", dated Dec. 28, 2018, 7 pages.
U.S. Appl. No. 15/498,515, "Notice of Allowance", dated Feb. 13, 2019, 5 pages.
U.S. Appl. No. 15/498,515, "Supplemental Notice of Allowance", dated Mar. 20, 2019, 2 pages.
U.S. Appl. No. 15/592,236, "Notice of Allowance", dated Mar. 6, 2019, 7 pages.
U.S. Appl. No. 15/631,096, "Notice of Allowance", dated Mar. 12, 2019, 5 pages.
U.S. Appl. No. 15/592,236, "Supplemental Notice of Allowability", dated May 13, 2019, 3 pages.

* cited by examiner

INDUSTRIAL TRUCK COMPRISING A DEVICE FOR REDUCING VIBRATIONS

CROSS REFERENCE TO RELATED APPLICATION

This application claims priority to German Patent Application No. 10 2016 207 526.8, filed in Germany on May 2, 2016, the entire contents of which are hereby incorporated herein by this reference.

The invention relates to an industrial truck comprising a mast, a load-carrying apparatus, which can be moved upwards and downwards thereon and which has at least one load-receiving means for receiving a load that is to be transported, and a support structure connecting the load-receiving means to the mast, the load-receiving means having a load-carrying arrangement connected to the support structure, and a device for reducing vibrations.

The invention can be used particularly advantageously for sideloaders and high-bay stacker trucks, in particular tri-lateral sideloaders for order picking, in which load-carrying fork arms for lateral push operations are orientated or can be oriented transversely to the straightforward direction of travel of the industrial truck. Using such sideloaders constructed as high-bay stacker trucks, the insertion and removal of whole pallets and the picking of individual items from the high bays can be combined effortlessly. High-bay stacker trucks of the type under consideration here include those in which a cab is arranged on the mast so as to be movable upwards and downwards by means of a cab carrier, a lateral push frame being provided on the front of the cab, which lateral push frame is movable upwards and downwards on the mast together with the cab and supports a load-carrying apparatus which is laterally movable back and forth, transversely to the straightforward direction of travel of the industrial truck. Since the cab and an operator located thereon can be moved vertically on the mast together with the load-carrying apparatus, these types of industrial trucks are also called man-up industrial trucks or man-up industrial trucks. In the case of various construction types of man-up industrial trucks, the mast can be extended and retracted telescopically, the cab being fastened in a height-adjustable manner to the highest extendable telescopic stage of the mast.

The load-carrying apparatus that is movably guided on the lateral push frame can comprise an additional mast with load-receiving means that can move upwards and downwards thereon relative to the driver's platform, which load-receiving means are normally load-carrying arms or a load-carrying fork having such load-carrying arms. The additional mast is arranged on a pivoting pusher and is pivotable thereon by approximately 180° about a normally vertical axis such that the load-carrying fork fastened to the additional mast so as to be height-adjustable can be pivoted out of a position in which it is oriented laterally, transversely to the straightforward direction of travel of the industrial truck, into a position in which it is oriented in an opposing lateral position. The pivoting pusher is linearly guided on the lateral push frame.

A typical task for the industrial truck is, for example, to put a pallet comprising a load located thereon in a bay for storage, the industrial truck being located in a narrow aisle between bays of a high-bay warehouse and the pallet being received on the load-carrying fork. The pallet is inserted into the bay laterally, transversely to the straightforward direction of travel of the industrial truck, it being assumed that the load-carrying fork is already correctly oriented on the desired storage area so as to be oriented laterally towards the bay, and the pivoting pusher together with the additional lifting platform provided thereon is located in a lateral end position at the end of the lateral push frame that is remote from the bay in question. The loaded pallet can then be inserted into the bay by means of a linear lateral movement of the pivoting pusher along the lateral push frame.

To drive the various movable components on the mast, various controllable drive means are provided. Depending on the equipment of the industrial truck, said trucks are used to move the load-carrying means on the additional mast, to pivot the additional mast about a vertical axis, to move the load-carrying apparatus and pivoting pusher on the lateral push frame, to move the driver's platform on the mast and optionally to telescopically extend and retract the mast and to move the lateral push frame relative to the driver's platform. Normally and preferably, said means are hydraulic drive means, although other drives should not be ruled out.

It is a known problem that, in the case of industrial trucks of the kind under consideration here, vibrations on the mast, in particular vibrations with lateral vibrating components, i.e. vibrating components directed transversely to the straightforward direction of travel of the industrial truck, occur, in particular when travelling over an uneven surface. Such vibrations are often more intense the higher the driver's platform and its devices, which are built on at the front, have been raised on the driver's platform and if applicable, the greater the load that has been received by means of the load-carrying apparatus. Such vibration movements can be unpleasant for an operator located in the cab and make the placement of pallets into bays and their retrieval from bays difficult or even sometimes impossible such that the operator can only begin a placement or retrieval procedure safely when the vibrations have subsided once the industrial truck is stationary. Alternatively, the operator could in principle drive the industrial truck at a reduced speed when travelling over uneven ground in order to largely prevent excitation of vibrations. Both would, however, reduce productivity when working with the industrial truck.

A industrial truck of the kind referred to at the beginning, which is designed as a man-up industrial truck and in which measures to reduce vibrations have already been taken, is known from EP 2 368 832 B1. These measures consist of an assembly described as a load-receiving portion, which is movable upwards and downwards on the mast and coherently comprises the cab and the load-carrying apparatus connected thereto, being attached to the mast such that it can collectively perform movements transversely to the straightforward direction of travel (main direction of travel) of the industrial truck with a lateral, i.e. normally horizontal, movement component relative to the mast, a separate degree of movement freedom being established for the assembly for this purpose, which is not provided for the planned operation of the industrial truck. The known industrial truck has means for damping or preventing vibrations in the relative position between the load-receiving portion and the mast, i.e. between the driver's platform (cab) and the mast. In this case, these can be active, semi-active and/or passive vibration-damping means, which are suitable for generating a force or torque between the mast and the load-receiving portion that has a component along the separate degree of movement freedom which is not provided for the planned operation of the industrial truck. In EP 2 368 832 B1, damping elements and springs among other things are proposed for reducing vibrations, which counteract a deflection of the mast and the assembly described as the load-receiving portion along the separate degree of movement freedom. A disadvantage of this known solution is the relatively high assembly complexity in order to attach to the mast the entire assembly, which consists of the driver's platform and all of the load-receiving components that are vertically movable together with said cab on the mast, whilst establishing the separate degree of movement freedom which is not provided for the planned operation of the industrial truck. Retrofitting an industrial truck concerned with these known vibration-reducing measures would also be complicated and costly.

The object of the invention is to provide an industrial truck of the kind referred to at the beginning, which is equipped with vibration-reducing measures which are relatively easy to achieve in terms of assembly and which allow for efficiently vibration-reducing operation in particular without barely any influence on the comfort of an operator whilst they are on an on-board cab.

According to the invention, an industrial truck is proposed, in particular an industrial truck comprising:

a mast, a load-carrying apparatus, which can be moved upwards and downwards thereon and which has at least one load-receiving means for receiving a load that is to be transported, and a support structure connecting the load-receiving means to the mast, the load-receiving means having a load-carrying arrangement connected to the support structure, and a device for reducing vibrations, the industrial truck being characterised in that the device for reducing vibrations has at least one load support, which covers the load-carrying arrangement at the top at least in portions, on which support a load received by the load-carrying apparatus can be supported and is provided so as to be movable to a limited extent on the load-carrying arrangement such that it can perform vibration-reducing movements relative to the load-carrying arrangement.

According to the present invention, the device for reducing vibrations can allow for a vibration-reducing compensation movement directly at the interface between the load-receiving means and a load received on its load-carrying arrangement, such that the load standing on the load support, together with the load support, can perform vibration-reducing compensation movements on the load-carrying arrangement. In principle, the load support could be arranged on the load-carrying arrangement such that it is mounted so as to be movable to a limited extent in various directions and, optionally so as to even be pivotable to a certain extent about one optionally more axes and its mass and the mass of a load that may be supported thereon is "decoupled from or soft-coupled to" the mass of the rest of the industrial truck.

A basic concept of the invention is not to rigidly couple the load support and any load supported thereon, i.e. the masses thereof, and the rest of the industrial truck, i.e. its mass, to one another such that the load support and the load supported thereon can preferably only follow accelerated movements, which occur in the event of mast vibrations, indirectly or with a delay or phase shift, and kinetic energy is thereby converted into another form of energy, in particular heat.

The load-carrying arrangement preferably comprises at least one load-carrying arm, most preferably a load-carrying fork comprising load-carrying arms, on which the load support is held in order to perform vibration-reducing movements relative thereto. In an embodiment of the invention which is particularly simple to implement, the load support is only or at least mainly movable to a limited extent in the main extension direction (longitudinal direction) of the load-carrying arms.

According to a development of this embodiment of the invention, a load-carrying fork comprising a pair of load-carrying arms is provided as the load-carrying arrangement, each of the load-carrying arms carrying a portion of the load support assigned thereto and the portions of the load support being guided on the load-carrying arms so as to be moved to a limited extent in the longitudinal direction of said arms such that the portions of the load support can perform vibration-reducing movements in the longitudinal direction of the load-carrying arms. In such an embodiment of the invention, the load support can thus be divided into separate portions. According to a preferred variant of the invention, in order to guide the portions of the load support, each of the load-carrying arms can be covered on the outside of their upper side and the two lateral sides adjacent thereto by a portion of the load support assigned in each case. In this case, the portions of the load support thus surrounding the load-carrying arms on multiple sides can slide back and forth on the load-carrying arms in their movement range, for example, in relation to a preferred resting position or zero position.

According to one embodiment of the invention, the portions of the load support can be movably guided substantially only in a sliding manner on the load-carrying arms, it being possible for at least one of the surfaces sliding along one another to have a friction lining in order to generate a braking effect during the movement of the portions of the load support relative to the load-carrying arms. Such friction linings can, for example, be provided on at least one of the opposite lateral side surfaces of a portion of the load support that touch one another and one load-carrying arm. In generally, end stops can be provided, which limit the movement range of the load support.

According to another embodiment of the invention, the portions of the load support are supported on rollers, which are rotatably mounted on the load-carrying arms such that the portions of the load support can perform vibration-reducing movements relative to the load-carrying arms by the rollers rotating. This embodiment of the invention also allows for variants. One of these variants could be that the rollers are mounted relatively tightly such that they have a braking effect on the movement dynamics of the portions of the load support, it also being possible for this to be variable depending on the mass of a received load.

Additionally or alternatively, the rollers could also be designed and mounted such that a resilient restoring force, such as that of a torsion spring, for example a coil spring, acts thereon, the restoring force loading the relevant roller towards a preferred rotational rest position.

According to another variant, the rollers could also be mounted in a smooth-running manner and a vibration-reducing influence on the movement of the load support be undertaken by means of other devices.

For example, a passive and/or active damping system which influences the movement of the load support relative to the load-carrying arrangement can therefore be coupled to the load-carrying arrangement. Such a damping system can be arranged at a suitable point of the load-carrying apparatus, for example on vertical portions of load-carrying arms (fork uprights) or on a fork carrier.

In the embodiment as a passive damping system in particular, said passive damping system preferably comprises a friction-damping arrangement. Friction-damping arrangements can be achieved in various configurations, such as a friction bracket-friction rail pair, where one of the components of such a pair should be coupled to the load-carrying arrangement and the other component should be coupled to the load support.

A friction-damping arrangement which would be an option for the present invention can comprise at least one hydraulic and/or pneumatic friction-damping cylinder according to one embodiment.

Furthermore, the damping system preferably comprises a spring arrangement which is adjusted such that it stresses or pretensions the load support, i.e. for example the portions of the load support received on load-carrying arms, towards a target rest position (zero position).

It can also be provided for a movement of the load support relative to the load-carrying arm to be braked to a standstill outside of the zero position by friction (or optionally at a stop) and the friction brake to then be lifted such that the load support is then brought back into a zero position by means of spring force and/or by an actuator.

According to another embodiment of the invention, the damping system comprises at least one active component, in particular at least one controllable hydraulic and/or pneumatic cylinder and/or at least one controllable electric motor, preferably a servomotor, the active component of the damping system acting between the load-carrying arrangement, i.e. for example between a load-carrying fork or a load-carrying arm of said fork and the load support or at least one of the portions of said support, in order to apply pressure to the load support in a vibration-reducing manner. In this case, the masses of the load support together with the load standing thereon and of the load-carrying apparatus which are decoupled or soft-coupled to reduce vibrations, are actively and dynamically tendentially held relative to one another in their zero position.

A control device is provided in an active system in order to control the active components. Furthermore, sensors can be provided which detect the vibration amplitudes of the mast or components arranged thereon in a height-adjustable manner, it being possible for the control device to process data from said sensors in order to control the active components in the sense of optimised vibration reduction. In this sense, sensors can also be provided which detect the relative movement of the load support relative to the load-carrying arrangement.

As already described above, the present invention can be advantageously used in particular for a sideloader, in particular constructed as a high-bay stacker truck, in order to reduce transverse vibrations of the mast and components arranged thereon in a height-adjustable manner, i.e. vibrations with components transverse to the straightforward direction of travel of the industrial truck. Accordingly, the industrial truck is preferably designed as a sideloader, in particular a tri-lateral sideloader, which has a load-carrying fork comprising load-carrying arms as the load-carrying arrangement, which arms are orientated or can be oriented transversely to the straightforward direction of travel of the industrial truck, the load support being able to perform vibration-reducing movements along the load-carrying fork arms and therefore transversely to the straightforward direction of travel of the industrial truck.

An embodiment of the invention, in which the industrial truck is an industrial truck comprising load-carrying fork arms oriented in the straightforward direction of travel, should, however, not necessarily be ruled out as a result.

According to a development of the invention, the device for reducing vibrations can be selectively activatable and deactivatable. For this purpose, a controllable locking apparatus can be provided, which substantially rigidly couples the load support to the load-carrying arrangement in the deactivated state of the device for reducing vibrations, and which releases the load support from the rigid coupling when the device for reducing vibrations is activated.

According to one embodiment of the invention, the device for reducing vibrations is controllable, in particular activatable and deactivatable, depending on the particular operating state of the industrial truck. The device for reducing vibrations can be controlled depending on the configuration of this embodiment, for example depending on the acceleration of travel and/or travel speed of the industrial truck, on the particular lifting height of the load-carrying apparatus, the mass of the load, on the orientation of load-carrying fork arms, on impacts, for example when travelling over uneven ground, etc., sensors or other detection means for detecting these parameters being provided. For example, according to one variant of the invention, the control system of the device for reducing vibrations can change the "rigidity and hardness" of the coupling between the load support and the load-carrying arrangement on the basis of one or more of said parameters. The lower the need for reducing vibrations, the more rigid or harder the coupling between the load support and the load-carrying arrangement, for example, can be set.

If it is only intended for the device for reducing vibrations to reduce transverse vibrations, for example, it can be provided for it to be controllable depending on the orientation of the load-carrying fork arms and/or depending on the lifted vertical position of the load-carrying fork arms and/or only when the industrial truck is stopped in the narrow aisle such that it operates, for example, in the narrow aisle when the load-carrying fork arms are positioned transversely in relation to the straightforward direction of travel of the industrial truck.

Embodiments of the invention are described below with reference to the figures.

FIG. 1 is a side view of an embodiment of an industrial truck according to the invention, which is designed as a tri-lateral high-bay stacker.

Figure 2A:
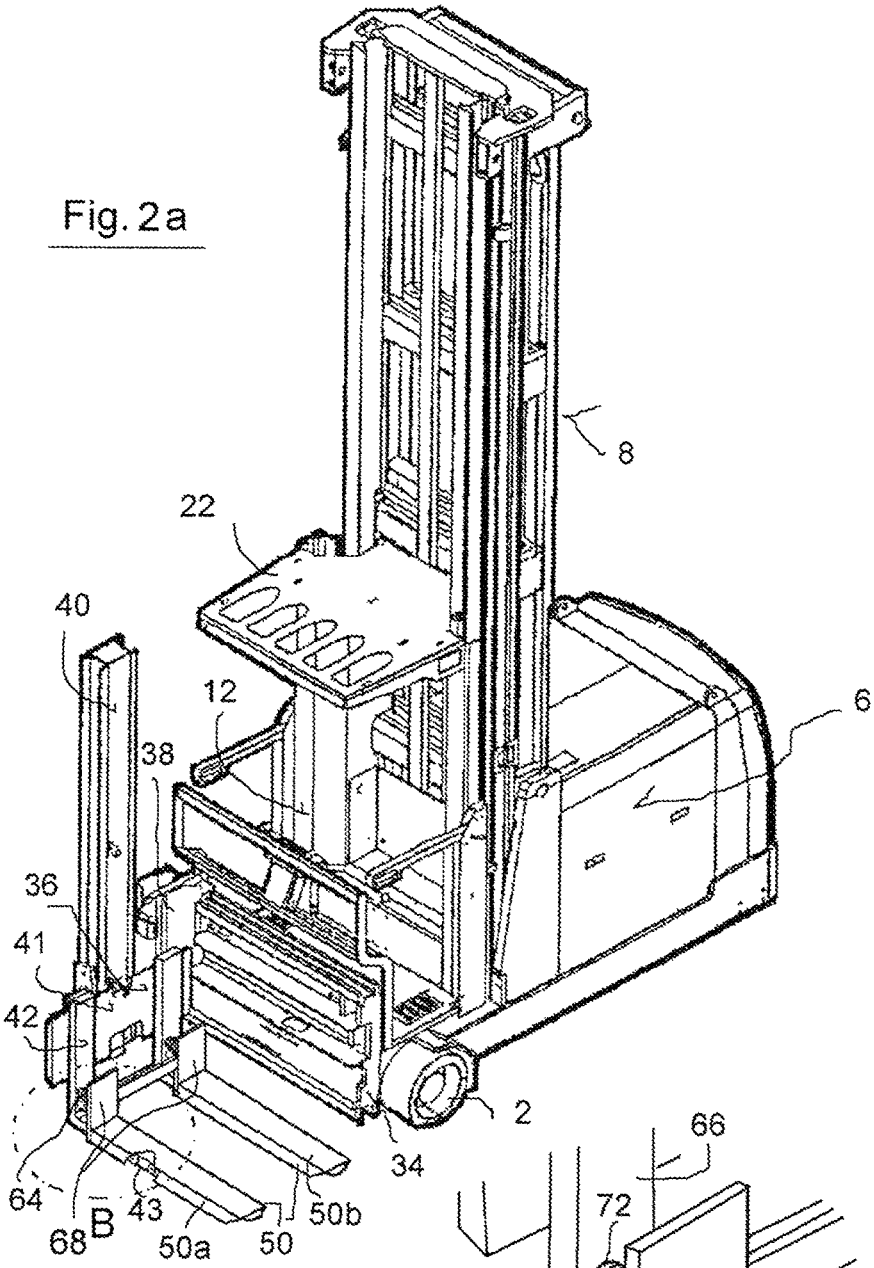

FIG. 2*a* is a perspective view of a tri-lateral high-bay stacker according to the invention which is very similar to the tri-lateral high-bay stacker from FIG. 1.

Figure 2B:
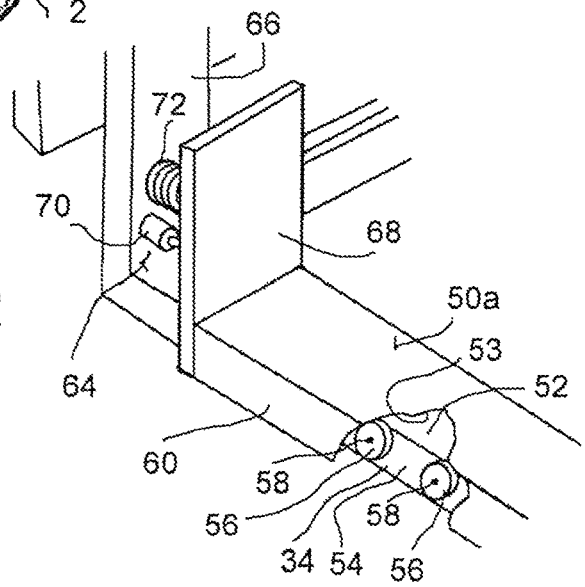

FIG. 2*b* is an enlarged view of a region marked B in FIG. 2*a*, a load support portion being shown with some of it removed in order to make rollers visible.

Figure 3A:
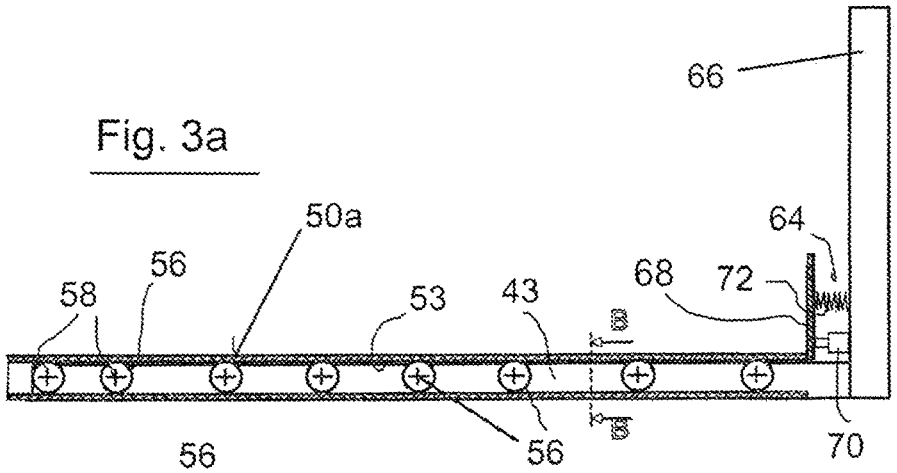
Figure 3B:
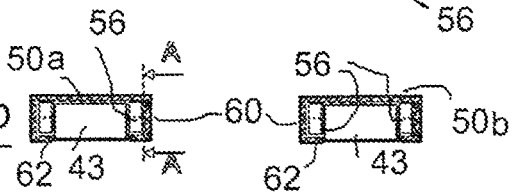

FIG. 3*a* is a sectional side view with the sectional plane indicated at A-A in FIG. 3*b* of a load-carrying arm having a load-support portion resting thereon.

FIG. 3*b* is a section through the arrangement from FIG. 3*a* with the sectional plane indicated at B-B in FIG. 3*a*.

Figure 3C:
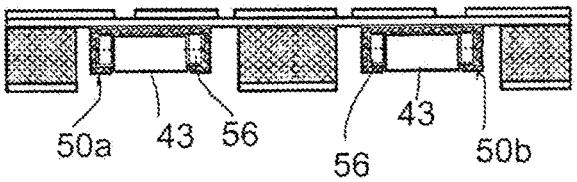

FIG. 3*c* shows the arrangement from FIG. 3*b*, namely a pair of load-carrying arms with load-support portions resting thereon which engage under a pallet.

Figure 4A:
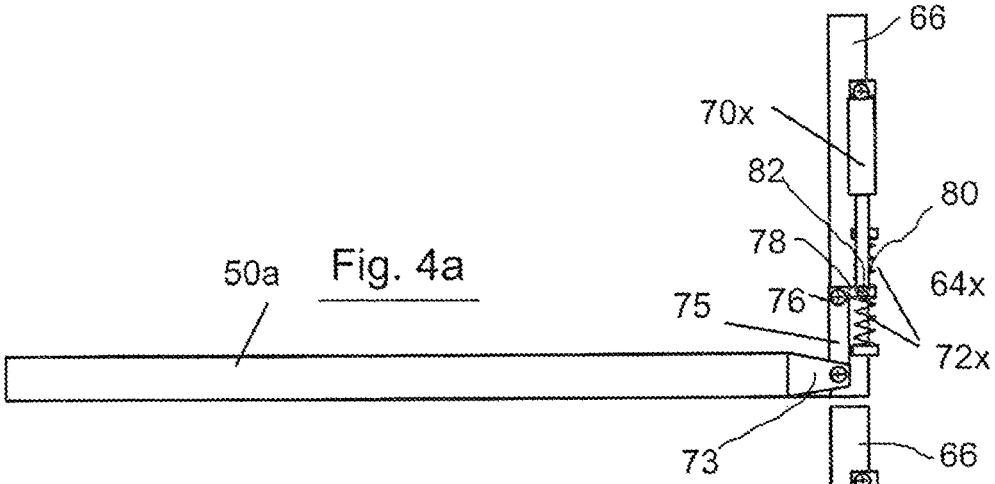
Figure 4B:
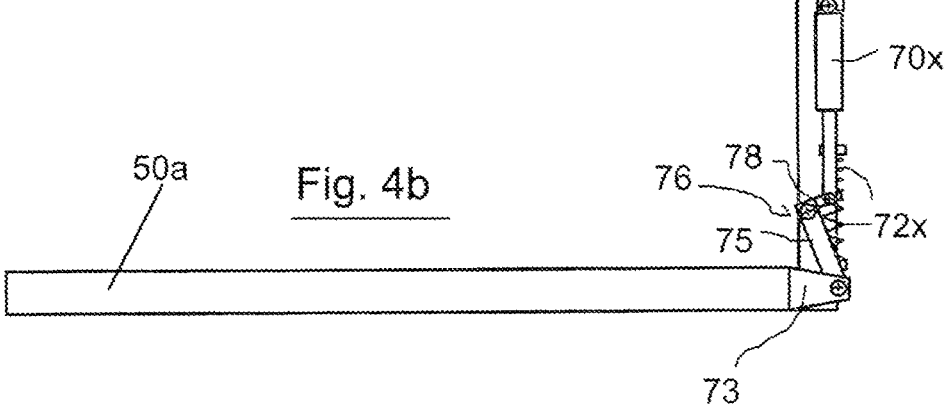

FIG. 4*a* and FIG. 4*b* are side views of a load-carrying arm with fork uprights and a load support portion resting on the load-carrying arm and with components of a vibration-damping system which are arranged laterally on the fork uprights, the load-support portion being shown in a zero position in FIG. 4*a* and in a deflected position in FIG. 4*b*.

FIG. 1 is a side view of an embodiment of an industrial truck according to the invention, in particular a high-bay stacker which is designed as a tri-lateral stacker.

The industrial truck comprises a chassis 6 supported via wheels 2 on the ground 4 and a mast 8 vertically fastened to the chassis 6. The mast 8 is constructed of multiple parts so as to be telescopically extendable, as can be seen from FIG. 1 by the extended position indicated by dashed lines. At the furthest extendable telescopic stage 10 of the mast 8, a cab 12 is attached such that it can move vertically by means of a cab support 24 in the form of a support structure. The cab 12 is constructed as a lifting driver's cabin, which has a frame comprising a cabin floor, back wall, side walls and driver overheard guard 22. In the front of the cab 12, a lateral push frame guide 26 is fixed to the cab support 24 and in this example, is formed from two fixed vertical columns, which have guide profiles 30 on their ends and retaining rails 32, for the lateral push frame 34, which can move longitudinally in said guide profiles.

The lateral push frame guide 26 allows for a laterally horizontal movement of the lateral push frame 34 in a plane transverse to the straightforward direction of travel G of the industrial truck (over-push function). This is a specific option of the industrial truck shown in FIG. 1. The lateral push frame 34 can be fixed directly to the support structure 24 in the case of models not having an over-push function (in particular at the front of the cab support).

A load-carrying apparatus 36, which is known per se, is arranged on the lateral push frame 34 so as to be laterally movable, transversely to the straightforward direction of travel G of the industrial truck. It comprises a pivoting pusher 38 that is movable on the lateral push frame 34, having an additional mast 40 arranged on the front thereof, on which platform a load-carrying fork 42 having a fork support arrangement is vertically movable as a load-carrying arrangement. The additional mast 40 can be pivoted together with the load-carrying fork 42 about the vertical axis 44 between the position shown in FIG. 1, in which the load-carrying fork 42 and its load-carrying arms 43 are oriented laterally (transverse orientation to the left in relation to the straightforward direction of travel G), and a position in which they are oriented in an opposite lateral position (transverse orientation to the right) of the load-carrying arms 43.

The special feature of the industrial truck according to the invention is a device for reducing vibrations which is designed to reduce vibrations with deflection components in the longitudinal direction of the load-carrying fork arms 43. For this purpose, in the embodiment shown, a load support 50 is provided in two portions 50*a* and 50*b*, which load support is movable to a limited extent relative to the load-carrying arrangement 41 and the associated fork arms 43. The load support 50 forms an interface capable of vibration-reducing movements in the longitudinal direction of the load-carrying fork arms 43 between the load-carrying fork 42 and a load received thereon (not shown). Each of the load-carrying fork arms 43 is assigned a particular portion 50*a* and 50*b* of the load support. Each portion 50*a* and 50*b* of the load support is a sleeve element resting on the load-carrying fork arm 43 assigned thereto and guided thereon for limited movement in the longitudinal direction thereof, which element covers the outside of the load-carrying fork arm 43 at least on its upper surface 52 and on the lateral sides 54 adjacent thereto.

The industrial truck shown in perspective in FIG. 2*a* is likewise a tri-lateral stacker having a device for reducing vibrations, which only marginally differs from the industrial truck shown in FIG. 1 for the purposes of explaining the invention. The statements made in relation to the industrial truck in FIG. 1 also apply in the same way to the industrial truck in FIG. 2. Features in FIG. 2*a*, which correspond objectively or functionally to features in FIG. 1, are correspondingly marked with the same reference numerals as the relevant features in FIG. 1.

In FIG. 2*a* and in particular in FIG. 2*b*, which is an enlargement of the detail indicated at B in FIG. 2*a*, some details of the device for reducing vibrations can be seen better. In the case of the industrial truck according to FIG. 2*a*, the device for reducing vibrations also has the same kind of sleeve elements 50*a*, 50*b* as portions of the load support 50, which each cover the outside of a fork arm 43 on the upper surface 52 and on the lateral sides 54. The portions 50*a*, 50*b* of the load support 50 do not have to be closed on the underneath. In this respect, a wrap-around underneath, which prevents the particular portion 50*a*, 50*b* from slipping off the load-carrying arm 43 assigned to it, suffices (c.f. also FIG. 3*a*-3*c* in this respect).

On both lateral sides 54, each load-carrying arm 43 has a set of rollers 56, which are fastened to the particular load-carrying arm 43 so as to be rotatable about horizontal axes of rotation 58 that extend in parallel with one another and support the relevant portion 50*a* or 50*b* on its surface 53 facing the upper side 52 of the load-carrying arm 43 such that the portions 50*a*, 50*b* of the load support 50 can perform vibration-reducing movements relative to the load-carrying arms 43, 43 while the rollers 56 are rotating. In FIG. 2*a* and FIG. 2*b*, one of the load-supporting portions 50*a* is shown with part of it broken away in order to make the rollers 56 visible.

The principle of supporting the portions 50*a*, 50*b* on the fork arms 43 on rollers can also be seen in the sectional views in FIG. 3*a*-3*c*. The uppermost positions of the rollers 56 are slightly higher than the upper surface 52 of the fork arms such that the surface 53 of the portions 50*a*, 50*b* is preferably exclusively supported on the rollers. The side walls 60 on the lateral sides of the portions 50*a*, 50*b* wrap around the end faces of the rollers 56 that point outwards to the sides, wrap-around portions 62 protruding from the lower ends of the side walls 60 that are on the lateral sides, which portions wrap around the rollers 56 underneath, leaving a small gap such that the portions 50*a*, 50*b* of the load support 50 on each of the load-carrying arms 43 are protected from rising up and are movably guided in the longitudinal direction of the load-carrying arms 43.

The portions 50*a*, 50*b* are coupled to the load-carrying arrangement 41 by a damping system 64 which influences the movement of the load support 50 relative to the load-carrying arrangement 41 (load-carrying fork 42). For each portion 50*a*, 50*b* of the load support 50, the damping system 64 comprises one hydraulic damping cylinder (optionally also an actuator cylinder) 70 and one helical spring 72 each, which are arranged substantially in parallel with one another in the embodiment according to FIGS. 2*a*-2*b* and 3*a*-3*c* and each connect a vertical portion 66 (upright) of a relevant load-carrying arm 43 to a rear stop plate 68 of an assigned portion 50*a* or 50*b*. According to one variant of the device for reducing vibrations, the damping cylinder 70 and the spring 72 form a passive damping system. The spring 72 is designed such that it attempts to force the relevant portion 50*a* or 50*b* of the load support 50 in each case towards a target rest position should the portion 50*a* or 50*b* have deflected out of said target rest position in each case during its vibration compensation movements. The damping cylinder 70 is designed such that it exerts a braking effect on the vibration movements of the portion 50*a* or 50*b* of the load support 50 connected thereto in order to convert kinetic energy into another form of energy, in particular heat, such that vibration damping of vibrations of the industrial truck, in particular of the mast 8, takes place with vibrating components in the longitudinal direction of the load-carrying arms 43. In a sideloader, if the load-carrying arms 43 are in a transverse position, transverse vibrations are therefore reduced.

FIGS. 4*a* and 4*b* are side views of a variant of a damping system 64*x* comprising a cylinder 70*x* and a pair of springs 72*x* on a load-carrying arm having an assigned portion 50*a* of the load support, and specifically in a target rest position of the portion 50*a* (FIG. 4*a*) and in a deflected position of the portion 50*a* (FIG. 4*b*). The portion 50*a* extends by means of a cantilever 73 as far as into the region of the vertical portion or upright 66 of the load-carrying arm and is connected there in an articulated manner to a lever arm 75 of a two-armed lever 76, which is mounted on the upright 66 so as to be rotatable about a horizontal axis. The second arm 78 of the lever 76 acts on the pair of springs 72*x*, which apply pressure to the lever 76 and therefore to the portion 50*a* of the load support towards a central target rest position. For this purpose, the second arm 78 of the lever 76 is connected to the pair of springs at the junction 80 of the pair of springs. Furthermore, the second arm 78 of the lever 76 is connected at the junction 80 to the piston rod end 82 of the hydraulic damping cylinder 70*x*, which is laterally hinged to the load-carrying arm upright 66 at the other end. Instead of the damping cylinder 70*x*, or in addition thereto, a separate friction-damping arrangement comprising a pair of friction elements consisting, for example, of a friction lug or friction rail and a friction bracket, could be provided, which can have friction linings and, for example, can have a frictional effect between the lever 76 and the load-carrying arm upright 66.

One variant of the device for reducing vibrations according to FIGS. 4*a* and 4*b* could be that the hydraulic cylinder 70*x* is operable as an actuator in each case, which can actively move the portion 50*a* of the load support relative to the load-carrying arm and, for example, reinstate the target rest position (zero position) should the pair of springs 72*x* not be capable of doing so alone. The target rest position (zero position) of the portion 50*a* can be monitored by means of sensors (not shown), which are connected to a control device which in turn serves to control the actuator. The maximum permissible relative movement between the portion 50*a* of the load support and the load-carrying arm 43 can also be detected and monitored by means of sensors (not shown) and limited by stop means.

It should be pointed out that according to variants of the embodiments shown, the rigidity of the spring arrangements 72 and 72*x* and/or the frictional effect of the friction-damping arrangement and brake effect of the damping cylinder 70 and 70*x* can be controllable depending on certain operating parameters or operating conditions of the industrial truck in order to modulate the vibration-damping effect as required.

While the industrial truck is travelling in a narrow aisle of a high-bay warehouse, the device for reducing vibrations would, for example, be activated, the friction-damping arrangement providing a frictional effect adapted to the current situation. If, when travelling over uneven ground, a transverse acceleration occurs at the mast 8 and at the cab support 24 and therefore at the load-carrying arms, which are oriented transversely to the straightforward direction of travel G, the transverse acceleration is transferred to the load support and any load that might be supported thereon by means of the friction-damping arrangement and the spring arrangement 72*x*. If the inertial force of the "decoupled or soft-coupled" masses exceeds the value of the adjusted frictional force and the spring force acting in parallel, a relative movement occurs between the load support and the load-carrying arms. This relative movement backwards and forwards relative to the target rest position reduces the overall vibration amplitude and kinetic energy is converted primarily into heat in the friction damping arrangement.

It should be pointed out that according to a variant of the device for reducing vibrations having at least one active component, the cylinder 70*x* shown in FIG. 4*a* and FIG. 4*b* constitutes such an active component as an actively controlled and dynamically effective actuator in order to apply pressure to the load support 50 in a manner that reduces vibrations.

The cylinder 70 in FIGS. 3*a*-3*c* could also be an active actuator cylinder in a corresponding embodiment.

A control device is provided in such an active system in order to control the active components. Furthermore, sensors can be provided which detect the vibration amplitudes of the mast or components arranged thereon in a height-adjustable manner, the control device being capable of processing data from said sensors in order to control the active components in the sense of optimised vibration reduction. In this sense, sensors can also be provided which detect the relative movement of the load support relative to the load-carrying arrangement.

Even though a man-up industrial truck comprising a vertically movable cab has been described as the embodiment of the invention, the invention is not intended to be limited thereto. It is just as applicable to so-called man-down industrial trucks having a fixed cab near the ground or "driverless" industrial trucks, for example automatic bay operating equipment.

The invention claimed is:

1. An industrial truck comprising:

a mast;

a load-carrying apparatus capable of being moved upwards and downwards thereon and which has at least one load-receiving means for receiving a load that is to be transported and a support structure connecting the load-receiving means to the mast, the load-receiving means having a load-carrying arrangement connected to the support structure; and a device for reducing vibrations, wherein the device for reducing vibrations has at least one load support, which covers a top region of the load-carrying arrangement, and a damping system that is configured to influence the at least one load support towards a target rest position, wherein a load received by the load-carrying apparatus can be supported on the at least one load support, wherein the at least one load support is provided so as to be movable to a limited extent on the load-carrying arrangement such that the at least one load support can perform vibration-reducing movements relative to the load-carrying arrangement, wherein the industrial truck is designed as a sideloader, which has a load-carrying fork having load-carrying arms comprising rollers as the load-carrying arrangement, wherein the damping system is arranged vertically on the load-carrying arms and is connected to the at least one load support via a lever arm, wherein the load-carrying arms are positioned or can be oriented transversely to a straightforward direction of travel of the industrial truck, the load support being capable of performing vibration-reducing movements along the load-carrying arms and therefore transversely to the straightforward direction of travel of the industrial truck.

2. The industrial truck according to claim 1, wherein each load-carrying arm of the load-carrying fork comprises a respective set of the rollers fastened to the respective load-carrying arm, wherein the load support on each load-carrying arm is configured to perform the vibration-reducing movements while the fastened set of rollers is rotating.

3. The industrial truck according to claim 1, wherein each of the load-carrying arms carries a respective portion of the load support, the portions of the load support being guided on the load-carrying arms so as to be moveable to a limited extent in a longitudinal direction of the load-carrying arms such that the portions of the load support can perform vibration-reducing movements in the longitudinal direction of the load-carrying arms.

4. The industrial truck according to claim 3, wherein an upper surface and two lateral sides adjacent thereto of each of the load-carrying arms are covered on the outside by the respective portion of the load support.

5. The industrial truck according to claim 3, wherein the portions of the load support are supported on the rollers which are rotatably mounted on the load-carrying arms such that the portions of the load support can perform vibration-reducing movements relative to the load-carrying arms when the rollers rotate.

6. The industrial truck according to claim 1, wherein the damping system comprises a passive damping system or an active damping system, which influences the vibration-reducing movements of the load support relative to the load-carrying arrangement.

7. The industrial truck according to claim 6, wherein the damping system comprises a friction-damping arrangement.

8. The industrial truck according to claim 7, wherein the friction-damping arrangement comprises at least one hydraulic friction-damping cylinder or pneumatic friction-damping cylinder.

9. The industrial truck according to claim 6, wherein the passive damping system or the active damping system comprises a spring arrangement.

10. The industrial truck according to claim 6, wherein the passive damping system or the active damping system comprises at least one active component, the active component being at least one controllable hydraulic cylinder, at least one controllable pneumatic cylinder, or at least one controllable electric motor, the active component of the passive damping system or the active damping system acting between the load-carrying arrangement and the load support in order to apply pressure to the load support in a vibration-reducing manner.

11. The industrial truck according to claim 1, wherein the device for reducing vibrations can be selectively activatable and deactivatable.

12. The industrial truck according to claim 11, wherein the device for reducing vibrations can be automatically activatable and deactivatable depending on one or more of: a particular operating state of the industrial truck, or the industrial truck being stopped in certain surroundings.

13. The industrial truck according to claim 1, wherein the device for reducing vibrations is controllable depending on one or more of an orientation of the load-carrying arms, a lifted vertical position of the load-carrying arms, or the industrial truck being stopped in certain surroundings.

* * * * *